United States Patent [19]

LeMoine

[11] 4,448,394

[45] May 15, 1984

[54] HIGH LOW SAFETY APPARATUS FOR DRILLING RIGS

[75] Inventor: Joseph L. LeMoine, Houston, Tex.

[73] Assignee: Koomey, Inc., Brookshire, Tex.

[21] Appl. No.: 432,052

[22] Filed: Sep. 30, 1982

[51] Int. Cl.[3] ..... B66B 5/08; B66D 1/56

[52] U.S. Cl. ..... 254/271; 242/49; 340/677

[58] Field of Search ..... 254/271, 270, 273; 242/36, 49, 57; 200/61.15, 61.16; 340/677, 675

[56] References Cited

U.S. PATENT DOCUMENTS

| | | | |
|---|---|---|---|
| 2,683,020 | 7/1954 | Nickle | 254/172 |
| 3,667,520 | 6/1972 | Flesch | 146/94 R |
| 3,677,520 | 7/1972 | Koomey | 254/173 |
| 3,994,449 | 11/1976 | Wales | 242/57 |

FOREIGN PATENT DOCUMENTS

| | | | |
|---|---|---|---|
| 2365374 | 1/1975 | Fed. Rep. of Germany | 254/271 |

*Primary Examiner*—Stuart S. Levy

*Assistant Examiner*—Joseph J. Hail, III

*Attorney, Agent, or Firm*—Fulbright & Jaworski

[57] ABSTRACT

A safety apparatus for preventing the traveling block of a drilling rig from being drawn into the top of the rig and also for preventing the traveling block from falling downwardly below a predetermined bottom position. A high position limiting valve has an air inlet and an air outlet with a valve stem providing communication between the inlet and the outlet when a predetermined amount of cable is spooled onto the drum. A low position limiting valve has an air inlet and an air outlet with a stem yieldably urged at all times into engagement with the cable for actuation and providing communication between the inlet and the outlet when a predetermined amount of cable is spooled off of the drum. An air supply is connected to the inlets of the valve and the outlets of the valves supply air to stop the actuation of the cable drum. The longitudinal axis of the valves are positioned generally perpendicular to the surface of the cable drum and their stems are longitudinally movable.

1 Claim, 2 Drawing Figures

HIGH LOW SAFETY APPARATUS FOR DRILLING RIGS

BACKGROUND OF THE INVENTION

The use of safety devices for automatically preventing the traveling block of a drilling rig from being pulled into the crown or top of the drilling rig and which are actuated by the cable that is coiled around the cable drum in order to control the rig clutch and brake is generally shown in U.S. Pat. Nos. 2,683,020 and 3,677,520. Thus, as the traveling block is raised a predetermined distance, the cable is wound on the cable drum and increases the diameter of the cable drum and actuates an air toggle valve which in turn engages the rig brake thereby stopping the traveling block. However, the present invention is also directed to providing a safety device to provide protection when the traveling block has reached a predetermined bottom position, normally known as falling block condition. That is, the traveling block may be supporting thousands of pounds of drilling pipe and if the operator fails for any reason to properly stop the downward travel of the traveling block extensive and expensive damage may occur. The present invention is directed to the provision and incorporation into the drawworks control system of means to activiate the brake and shut down the clutch when the traveling block reaches a low predetermined position.

SUMMARY

The present invention is directed to a safety apparatus for raising and lowering the traveling block of a drilling rig by a cable on a cable drum actuated by a prime mover which is controlled by a brake and clutch and which means are provided for not only preventing the traveling block from being raised above a predetermined high position, but for preventing the traveling block from being lowered below a predetermined low position.

A still further object is the provision of a high position limiting valve having an air inlet and an air outlet with the valve having a stem normally positioned spaced from the cable drum for actuation and providing communication between the inlet and the outlet when a predetermined amount of cable is spooled onto the drum. A low position limiting valve is provided having an air inlet and an air outlet. The low valve has a stem positioned contacting the cable on the drum for actuation and providing communication between the inlet and the outlet when a predetermined amount of cable is spooled off of the drum. An air supply is connected to the inlets of the high position valve and the low position valve and the outlets of the high position valve and the low position valve supply air to stop the actuation of the cable drum when either the high position or low position is reached by the traveling block.

Still a further object of the present invention is wherein the longitudinal axis of the high and low valves are positioned generally perpendicular to the surface of the cable drum and their stems are longitudinally movable for engagement and actuation by the cable being spooled on and off of the drum.

Yet a further object of the present invention is wherein the stem of the high position valve is normally positioned out of contact with the cable until actuated and the stem of the low position valve is yieldably urged at all times into engagement with the cable.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
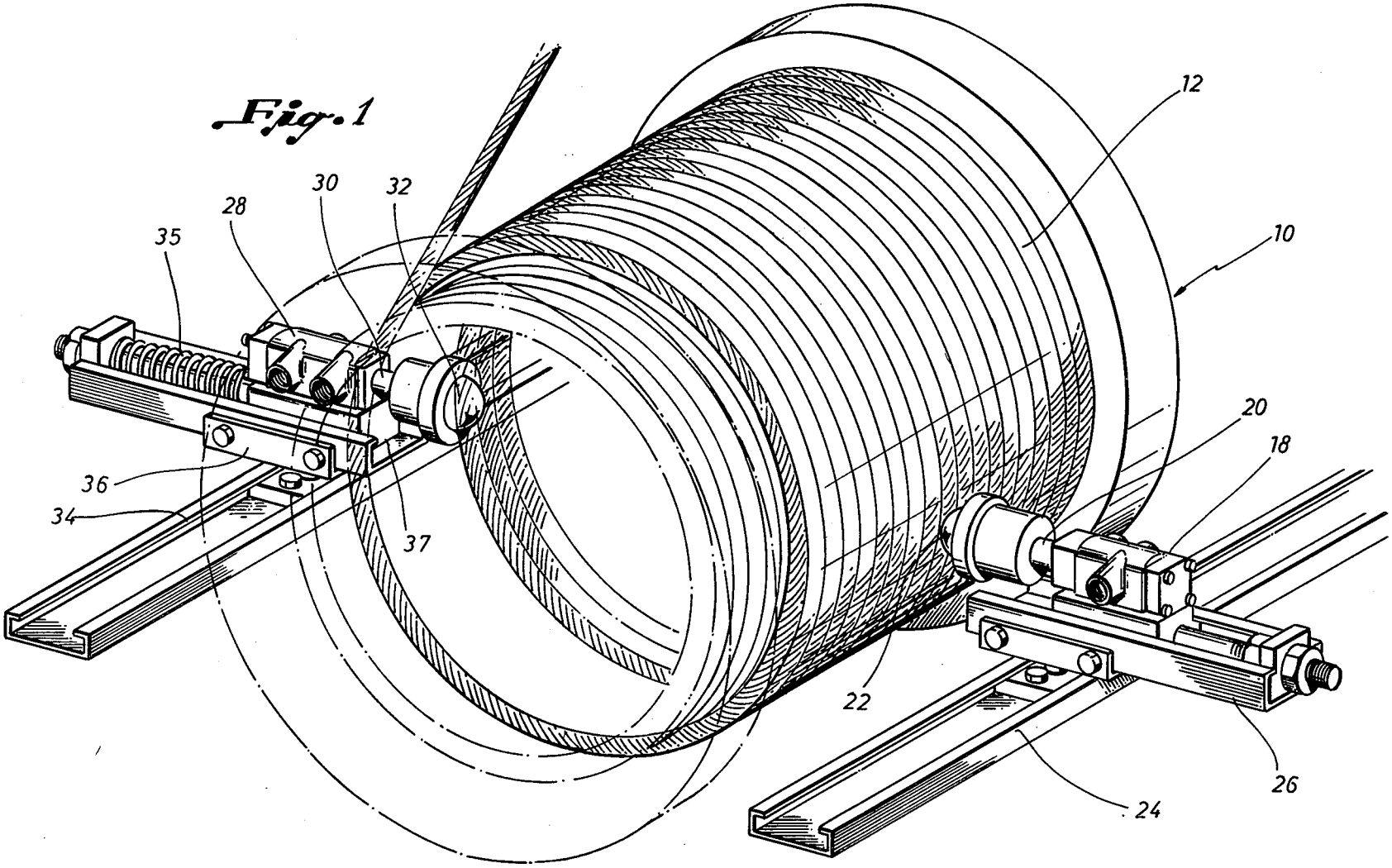
FIG. 1 is an elevational view perspective view of a cable drum showing the relationship of the high position limiting valve and the low positioning limiting valve relative to the cable on the cable drum.
Figure 2:
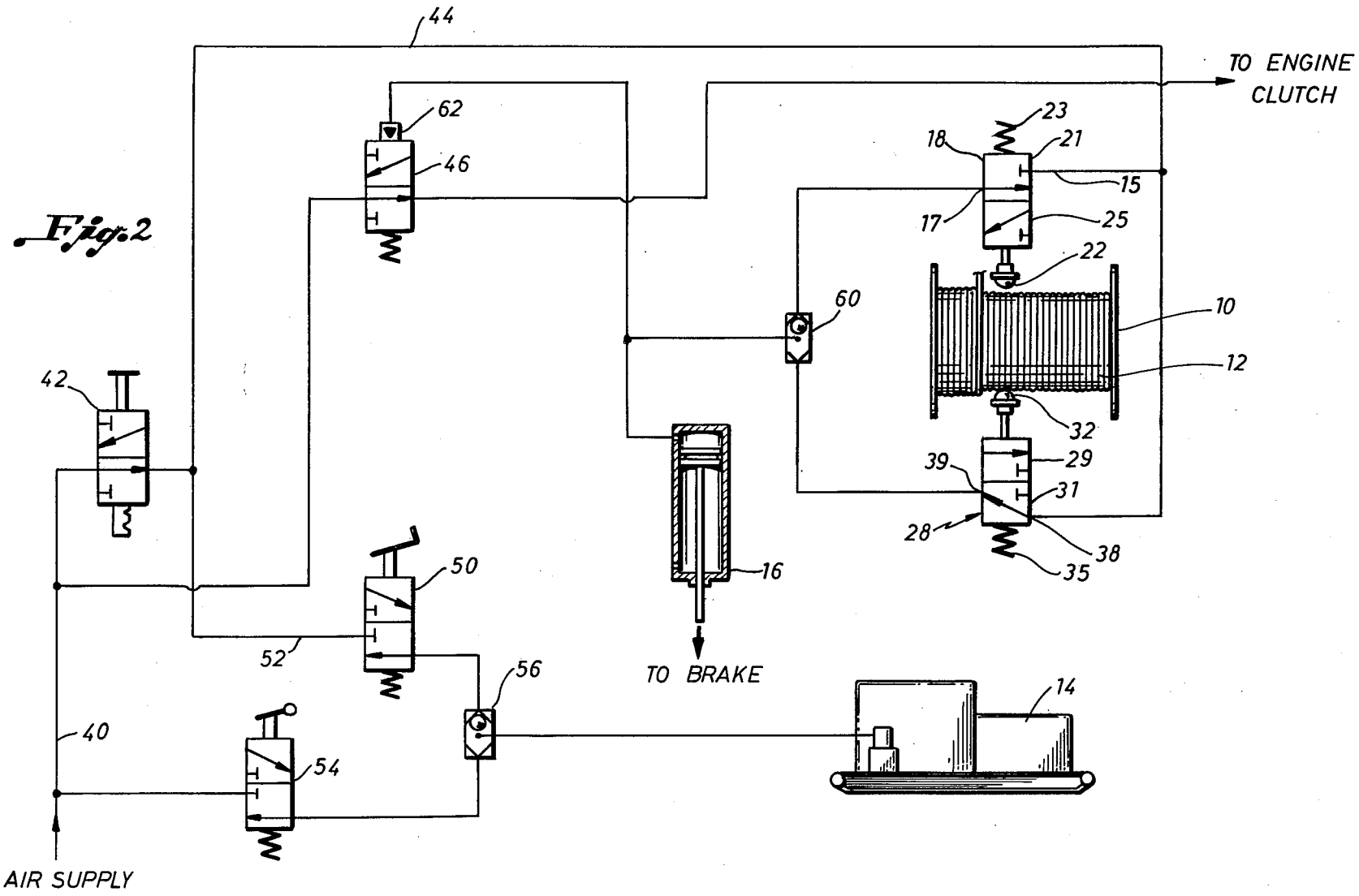
FIG. 2 is a schematic diagram of the control system of the present invention.

Referring now to the drawings, and particularly to FIGS. 1 and 2, the reference numeral 10 generally indicates a drawworks drum of a conventional drilling rig on which a cable 12 is being wound. The drawworks is conventional and is part of a conventional drilling rig having a traveling block (not shown) which raises and lowers lengths of drilling pipe and no further description is believed to be necessary. The drum is provided with a suitable power source such as engine 14, one or more clutches (not shown) and a brake cylinder 16, all of which are conventional. A high position limiting valve 18 is provided having a longitudinal axis which is positioned generally perpendicular to the surface of the cable drum 10 and includes a longitudinally movable stem 20 having a hemispherical surface 22 which is normally positioned spaced from the cable 12 of the drum 10. Preferably, valve 18 is mounted on a transverse track 24 and a longitudinal track 26 for suitably positioning the surface 22 at the desired position so as to be actuated when a sufficient number of turns of the cable 12 have been spooled on the drum 10 indicating that the traveling block is at a predetermined top position. Referring to FIG. 2, a spring 23 normally holds a valve element 21 in the valve 18 seated preventing air from air inlet 15 flowing to air outlet 17. Movement of the surface 22 of the stem 20 moves a valve element 25 to a position between the inlet 15 and outlet 17 overcoming the spring 23 allowing passage of air through the valve 18.

Referring still to FIGS. 1 and 2, a low position limiting valve 28 which includes a stem 30 having a hemispherical surface 32 is positioned against the cable 12 on the drum 10. The valve 28 is positioned with its longitudinal axis generally perpendicular to the surface of the cable drum 10 and its stem 30 is longitudinally movable as the surface 32 engages and disengages from the cable 12 as it is wound and is unwound from the drum 10. The valve 28 is preferably mounted on a transversely extending track 34 and a longitudinally mounted track 36. The longitudinally movable stem 30 and hemispherical surface 32 allow the cable 12 to be wound and unwound past the surface 32. However, a spring 35 is provided which yieldably urges the valve 28, stem 30 and surface 32 into engagement with the cable 12. However, the inward movement of the valve 28 is limited by a stop 37 whereby further unspooling of the cable 12 when the traveling block reaches a predetermined low position will actuate the valve 28.

Referring to FIG. 2, the valve spring 33 normally urges valve element 31 into position between air inlet 38 and air outlet 39 to allow the passage of air through the low valve 28 when a predetermined amount of cable 12 is spooled off of the drum 10. However, so long as a sufficient amount of cable 12 is spooled on the drum 10 during normal operating conditions, the surface 32 will be moved outwardly overcoming the spring 33 (as well as spring 35) and moving valve element 29 into position between the air inlet 38 and the air outlet 39 preventing passage of air through the valve 28.

An air supply 40 is provided through a normally open manually reset valve 42 and through line 44 to the inlets 15 and 38 of the high valve 18 and the low valve 28, respectively. The air supply 40 also flows through normally open relay valve 46 to provide air to the engine clutch (not shown) for controlling the drawworks. In addition, an engine throttle control for controlling the engine 14 is provided by including a foot pedal 50 which is supplied by air through line 52 from valve 42 or by a hand throttle valve 54 connected to the air supply 40. A shuttle valve 56 is provided between the valves 50 and 54 and the engine 14 for allowing control of the engine by either valve 50 or 54.

Therefore, in normal operation, the high position valve 18 and the low position valve 28 are normally closed and the engine 14 and clutch is utilized to control the drawworks as desired.

It is noted that the high valve 18 and the low valve 28 are connected in parallel between an air supply through line 44 to their inlets 15 and 38 and their outlets 17 and 39, respectively, and are connected to a shuttle valve 60, and in turn to the brake 16 and to the pilot 62 on the relay valve 46. Therefore, if either of the valves 18 and 28 is actuated to allow air to flow therethrough from their inlets to their outlets, the brake cylinder 16 will be actuated, and the relay valve 46 will be actuated cutting off the air supply to the clutch thereby preventing further movement of the drum 10. As shown, the high position valve 18 is in a deactuated position, but the low position valve 28 is shown in the actuated position with element 31 in position between the inlet 38 and the outlet 39 thereby transmitting air therethrough to actuate the brake 16 and the relay valve 46.

Therefore, the present invention will allow the normal operation of the drawworks of a drilling rig, but will automatically prevent the traveling block from being raised above a predetermined high position as determined by the setting of the high position valve 18 and will also prevent the traveling block from being lowered below a predetermined low position as determined by the low position valve 28.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a safety apparatus for raising and lowering a traveling block of a drilling rig by a cable on a cable drum actuated by a primer mover which is controlled by a brake and clutch, the improvement in means for preventing the traveling block from being raised above a predetermined high position and from being lowered below a predetermined low position comprising, a high position limiting valve having an air inlet and an air outlet, said valve having a stem normally positioned spaced from the cable drum for actuation and providing communication between the inlet and the outlet when a predetermined amount of cable is spooled onto the drum, a low position limiting valve having an air inlet and an air outlet, said valve having a stem positioned contacting the cable on the drum for actuation and providing communication between the inlet and the outlet when a predetermined amount of cable is spooled off of the drum, an air supply connected to the inlets of the high position valve and the low position valve, the outlets of the high position valve and the low position valve adapted to supply air to stop the actuation of the cable drum, the longitudinal axis of the valves are positioned generally perpendicular to the surface of the cable drum and their stems are longitudinally movable, and said stem of the high position valve is normally positioned out of contact with the cable until actuated and the stem of the low position valve is yieldably urged at all time into engagement with the cable.

* * * * *